United States Patent [19]

Focke et al.

[11] Patent Number: 4,715,497

[45] Date of Patent: Dec. 29, 1987

[54] SHOULDER BOX FOR CIGARETTES OR THE LIKE

[75] Inventors: Heinz Focke; Kurt Liedtke, both of Verden, Fed. Rep. of Germany

[73] Assignee: Focke & Co., Verden, Fed. Rep. of Germany

[21] Appl. No.: 637,237

[22] Filed: Jul. 31, 1984

[30] Foreign Application Priority Data

Aug. 16, 1983 [DE] Fed. Rep. of Germany ..... 3329456

[51] Int. Cl.[4] ..... B65D 85/10; A24F 15/00

[52] U.S. Cl. ..... 206/254; 131/329; 206/259; 206/264

[58] Field of Search ..... 131/329; 206/254, 259, 206/264

[56] References Cited

U.S. PATENT DOCUMENTS

| | | | |
|---|---|---|---|
| 1,488,044 | 3/1924 | Harms | 206/254 |
| 1,866,232 | 6/1932 | Butler | 206/254 |
| 2,997,163 | 8/1961 | Tel-Wardi | 206/254 |
| 3,596,823 | 8/1971 | Zitzelman | 206/254 |

FOREIGN PATENT DOCUMENTS

| | | | |
|---|---|---|---|
| 0072931 | 7/1982 | European Pat. Off. . | |
| 0646326 | 5/1937 | Fed. Rep. of Germany . | |
| 2044203 | 11/1970 | Fed. Rep. of Germany . | |
| 2720150 | 6/1977 | Fed. Rep. of Germany . | |
| 2652079 | 5/1978 | Fed. Rep. of Germany . | |
| 2815649 | 11/1979 | Fed. Rep. of Germany . | |
| 2847585 | 5/1980 | Fed. Rep. of Germany | 131/329 |
| 0793107 | 1/1936 | France . | |
| 1461594 | 1/1977 | United Kingdom . | |

*Primary Examiner*—V. Millin

*Attorney, Agent, or Firm*—Sughrue, Mion, Zinn, Macpeak & Seas

[57] ABSTRACT

Shoulder boxes (11) consist of box part (12) for receiving a group of cigarettes (10) and an articulated hinged lid (14). To achieve better aroma and moisture retention, the group of cigarettes (10) is wrapped in an inner wrapping (15) which, for the extraction of cigarettes, has in the region of a continuously closed upper wall (18) a tear-open thread (35) or a tear-open strip (36). In this way, easy access to the cigarettes (10) is possible.

13 Claims, 6 Drawing Figures

SHOULDER BOX FOR CIGARETTES OR THE LIKE

BACKGROUND OF THE INVENTION

The invention relates to a cigarette pack comprised of a box with a hinged lid connected to the box along an axis of articulation. Such a cigarette box is often called a shoulder box. A group of cigarettes or the like is wrapped in an inner wrapping or blank made, for example, of tin foil, to form a tin foil block which is placed in the box.

Shoulder boxes for cigarettes or the like are conventionally made of cardboard. The cigarettes are arranged to lie flat in several layers (especially two layers) in the box, generally perpendicular to the axis of articulation of the hinged lid connected to the box.

In these shoulder boxes, the inner wrapping of tin foil (often with a layer of glassine ply on the inside) has a closed bottom wall and upper closing tabs partially overlapping one another. To remove cigarettes, these closing tabs which are not connected to one another are swung to opposite sides, allowing access to the cigarettes. An inner wrapping of this type offers only slight protection against losses of aroma and moisture, since the upper side of the cigarettes is covered over its entire area by closing tabs which are not connected to one another.

SUMMARY OF THE INVENTION

The object of the invention is to provide a cigarette pack in which the inner wrapping offers better protection against losses of aroma and moisture from the cigarettes, but in which it is nevertheless easy to gain access to the cigarettes when the pack is used.

To achieve this object, the pack according to the invention has an inner wrapping with a top wall (i.e. upper wall) provided with a tear-open strip or a tear-open thread.

In the pack according to the invention, especially a shoulder box, the cigarette group is packaged in an inner wrapping to thus form a wrapped block of cigarettes. The upper wall of the inner wrapping is closed over its entire surface. To remove cigarettes, an extraction orifice is made in the upper wall by removing the tear-open strip or tear-open thread.

The tear-open strip or tear-open thread is preferably arranged in the center of the upper wall, and specifically in the direction of the longitudinal extension of the cigarettes, parallel to the axis of articulation of the hinged lid. The tear-open length predetermined by the tear-open strip or tear-open thread preferably extends over the entire length of the upper wall, so that at least the cigarettes lying in the middle are exposed over their entire length.

According to a further feature of the invention, transversely directed tearing lines adjoin the ends of the tear-open strip/tear-open thread or the tearing length, preferably on both sides of the tear-open strip/tear-open thread. When these tearing lines are severed, two opening tabs are obtained, and these each correspond preferably to approximately half the dimesion of the upper wall. The tearing lines are marked in the tin foil blank by any of several conventional means such as perforation means or stamping means, which weaken the material in the area of the tearing lines.

The production of a blank for packs according to the invention is simple in terms of machinery needed, as is the wrapping operation. In addition, an efficient use of machinery is realized. Elongate rectangular blanks are formed successively from a continuous sheet of tin foil material, the tear-open strip or tear-open thread being applied continuously approximately in the center of the sheet of material. The shorter limited tearing zone is determined by means of transverse stamped portions in the tin foil blank or by means of severing cuts in the tear-open strip or tear-open thread. Furthermore, according to the invention, a gripping tongue which can be grasped by hand is formed as a result of appropriate stamping.

Further features of the invention relate to the design of the inner wrapping, especially to the arrangement and formation of the tear-open strip or tear-open thread.

BRIEF DESCRIPTION OF THE DRAWINGS

Preferred embodiments of the invention are explained in more detail below with reference to the drawings in which.

DETAILED DESCRIPTION OF THE PREFERRED EMBODIMENT

Figure 1:
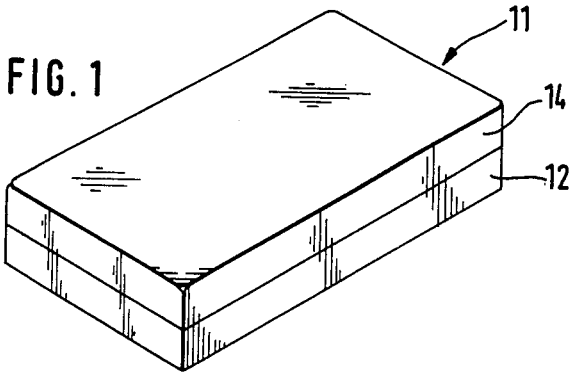
FIG. 1 is a perspective view of a closed shoulder box.

The pack illustrated in the drawings receives cigarettes 10. This pack is designed as a shoulder box 11, with a box portion 12 and a hinged lid 14 connected to the latter along an axis of articulation 13.

The box 12 receives the cigarettes 10 which are combined into a cigarette group and wrapped in an inner wrapping 15, which may be made of tin foil. The cigarette group wrapped in wrapping 15 forms a tin foil block 16 which is placed in shoulder box 11, so that the cigarettes 10 are aligned with their longitudinal axes parallel to the axis of articulation 13.

The shoulder box 11 may be made of cardboard and is, of itself, conventional. The hinged lid 14 has a depth less than that of the box 12. When the box is closed, an upper set-back shoulder 17 is surrounded by the hinged lid 14. The axis of articulation 13 extends approximately at half the height of the box 12 in the region of the transition between the shoulder 17 and the lower part of the box part 12.

The cigarettes 10 are arranged in several, preferably three layers one on top of one another. According to FIGS. 4 and 5, the blank from which the inner wrapping 15 enclosing the cigarettes 10 is formed is designed in such a way that it has an upper wall 18, a first end wall 19 and a lower wall 20 arranged in succession in the longitudinal direction of the rectangular inner wrapping blank. End-wall tabs 21 and 22 adjoin the free sides of the upper wall 18 and the lower wall 20, respectively. Longitudinal wall tabs 23 and 24, and 25 and 26 extend laterally on both sides of the upper wall 18 and the lower wall 20, respectively. These tabs are connected to one another by means of corner tabs 27 and 28 in the region of the closed end wall 19. Appropriate corner tabs 29 and 30 are located in the region of the end-wall tabs 21 and 22. The above-mentioned walls and tabs are marked in the continuous inner blank 15, free of incisions and stampings, by folding lines which take effect when the group of cigarettes 10 is wrapped.

Figure 2:
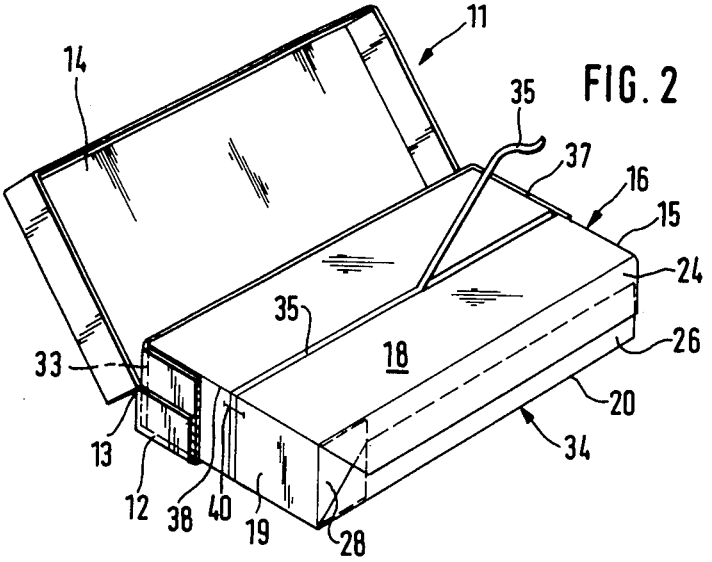
FIG. 2 shows the shoulder box according to FIG. 1 in the open position, with a tin foil inner wrapping having a tear-open thread in the upper wall of the inner wrapping.
Figure 3:
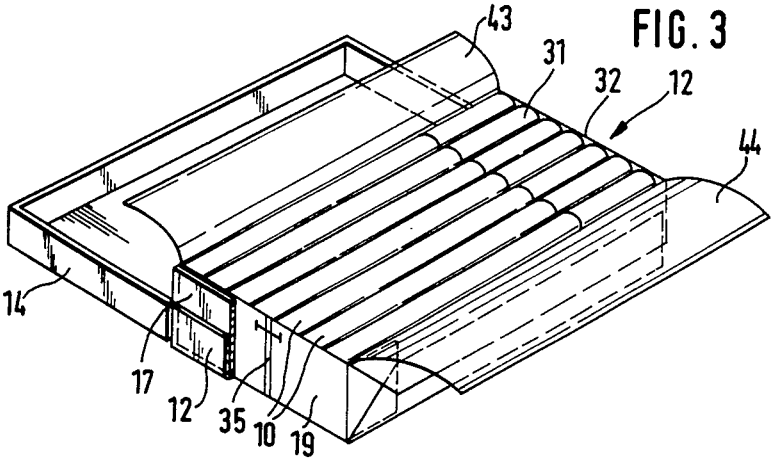
FIG. 3 shows the shoulder box according to FIG. 2 with the inner wrapping in the open position.

As is evident from FIGS. 2 and 3, the inner blank 15 designed in the above way is folded in the form of a U around one end face of the group of cigarettes 10, such as the end face located opposite the filter tips 31 of the cigarettes 10. The end-wall tabs 21 and 22 thereby pass over the end faces of the cigarettes opposite the filter tips. Here, the end-wall tabs 21 and 22 partially overlap one another to form an end wall 32 located opposite the end wall 19. At the same time, the corner tabs 29 and 30 are folded into the plane of this end wall 32.

Longitudinal side walls 33 and 34 of the tin foil block 16 are formed by the longitudinal wall tabs 23 . . . 26. The corner tabs 27 and 28 adjoining the end wall 19 are lokewise folded into the plane of the longitudinal side walls 33, 34. The longitudinal wall tabs 23 . . . 26 thereby acquire a trapezoidal shape. As a result of these folds, the upper wall 18, the end wall 19 and the lower wall 20 are free of folds and overlaps.

To allow access to the cigarettes 10 in the shoulder box 11, an extraction orifice is formed in the upper wall 18. For this purpose, the upper wall 18 is provided with a tear-open device such as tear-open thread 35 (FIG. 4) or a tear-open strip 36 (FIG. 5). The tear-open thread 35 or tear-open strip 36 is applied, in the direction of the longitudinal extension of the rectangular upper wall 18, to the inside or underside of the latter. In the illustrated embodiment, this tear-open device is located in the center of the upper wall 18. The effective tearing length defined by the tear-open thread 35 or tear-open strip 36 extends over the full length of the top or upper wall 18 from one end-wall edge 37 to the next end-wall edge 38. In the present exemplary embodiment, the tear-open thread 35 or tear-open strip 36 extends into the adjacent end walls 19 and 32. In the design using a tear-open thread 35 (FIG. 4), a gripping tongue 39 is formed at one end of inner wrapping 15 by stamping or the like. By means of this gripping tongue, the tear-open thread 36 can be grasped and the tear-open operation started. The effective length of the tear-open thread 35 or of the tear-open strip 36 is defined by transverse stamped portions 40 or 41 and 42, respectively.

To form the best possible extraction orifice, transversely directed tearing lines adjoin the tear-open thread 35 or tear-open strip 36 in the end regions and, in the present case, extend in the region of the end-wall edges 37, 38. The transversely directed tearing lines can be predetermined in the blank forming inner wrapping 15 in the region of the end-wall edges 37, 38, by marking or otherwise weakening portions of the material, by means of stamping cuts. As a result, after the tear-open thread 35 or tear-open strip 36 has been actuated, the tearing lines can be severed in the region of the end-wall edges 37, 38 when the free edges of the slit-shaped orifice are grasped. This results in two opening tabs 43, 44, the dimensions of each of which correspond approximately to half the surface of the upper wall 18. When the opening tabs 43, 44 are swung sideways, the group of cigarettes 10 can be exposed over the entire top side of the box.

The inner wrappings 15 can be obtained by severing blanks from a continuous sheet 45 of tin foil or the like. As a result of the design and arrangement of the blanks within this continuous sheet, it is possible to apply a continuous tear-open thread 35 or tear-open strip 36 to the sheet 45. The effective tearing length of the tear-open thread 34 or tear-open strip 36 is defined by the transverse stamped portions 40, 41 or 42 even when the tear-open thrad 35 or tear-open strip 36 extends continuously over the entire length of the blank from which the inner wrapping 15 is formed.

In the exemplary embodiment of FIG. 5 (tear-open strip 36), the tear-open mechanism includes parallel separating lines 46, 47 which are provided laterally next to the tear-open thread 35 and at a short distance from it. These lines preferably consist of severing cuts which are interrupted by residual connections 48 of the material. Accordingly, when the tear-open strip 36 is actuted, a separating strip is detached from the upper wall 18 over the width of the distance between the separating lines 46 and 47.

Figure 4:
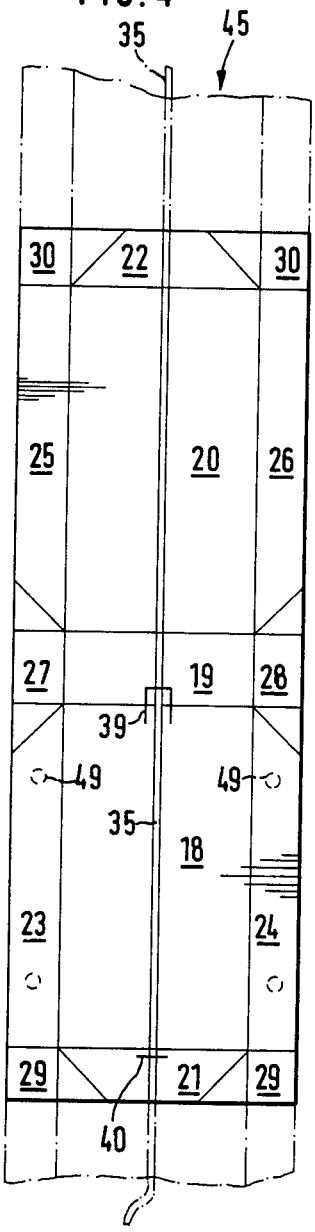
FIG. 4 shows a sheet of material for forming blanks with a continuous tear-open thread.
Figure 5:
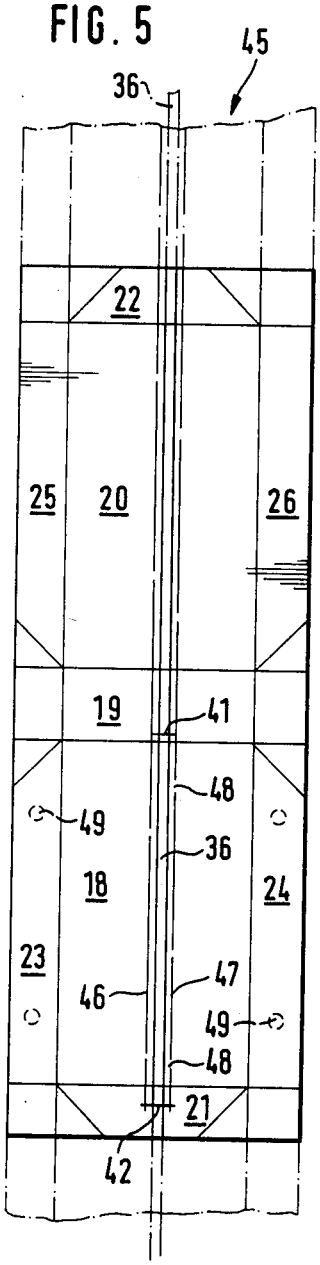
FIG. 5 shows a sheet of material corresponding to that of FIG. 4, with a tear-open strip.
Figure 6:
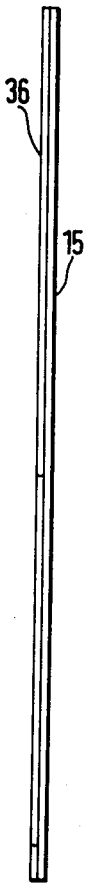
FIG. 6 shows, in the longitudinal section, a blank in the design according to FIG. 5 in the region of the tear-open strip.

As is also evident from FIGS. 4 and 5, individual overlapping tabs 23, 24 and 25 and 26, can be provided with glue points. Consequently, the longitudinal wall tabs 23 . . . 26 forming the longitudinal side walls 33, 34 are glued to one another at glue points 49 so that the entire tin foil block 16 acquires a dimensionally stable construction.

We claim:

1. A shoulder box with a box portion (12) and a hinged lid (14) connected pivotably to said box part along an axis of articulation (13), said box portion for receiving a group of cigarettes (10) wrapped in an inner tin foil wrapping (15), said group of cigarettes to be aligned to lie flat in the box part parallel to the axis of articulation; said inner tin foil wrapping comprising a closed upper wall (18) with one of a tear-open thread (35) and tear-open strip (36), and tearing lines located transverse to said thread (35) or strip (36) in the upper wall (18) such that after the thread (35) or strip (36) has been removed the upper wall can be formed into two opening tabs (43, 44) by tearing said upper wall along said tearing lines.

2. A shoulder box as claimed in claim 1, wherein the tear-open thread (35) or tear-open strip (36) is arranged in the center of the upper wall (18).

3. A shoulder box as claimed in claim 1 or 2, wherein the tear-open thread (35) or tear-open strip (36) is arranged in the direction parallel to the axis of articulation (13).

4. A shoulder box as claimed in claim 1, wherein said inner tin foil wrapping includes end-wall edges (37, 38) at the ends of said upper wall (18), said transverse tearing lines being formed along said end-wall edges (37, 38) formed at the ends of the upper wall (18).

5. A shoulder box as claimed in claim 4, wherein the tearing lines extend on both sides of the tear-open thread (35) or tear-open strip (36) over the full width of the upper wall (18) such that each of the opening tabs (43, 44) extends over approximately one-half of the upper wall (18).

6. A shoulder box as claimed in claim 1, wherein the tear-open thread (35) or tear-open strip (36) extends beyond the surface length of the upper wall (18) of the inner wrapping (15), such that the effective tearing zone of the tear-open thread (35) or tear-open strip (36) is at least equal to the length of the upper wall (18).

7. A shoulder box as claimed in claim 1, wherein the inner wrapping (15) includes separating lines (46, 47) on either side of the tear-open strip (36), said separating lines consisting of severing cuts with residual connections (48).

8. A shoulder box as claimed in claim 6, wherein the tearing zone is limited by transverse stamped markings (40, 41, 42) of the tear-open thread (35) or tear-open strip (36).

9. A shoulder box as claimed in claim 1, wherein a stamped U-shaped gripping tongue (39) is formed in the inner wrapping at one end of the tear-open thread (35) or tear-open strip (36).

10. A shoulder box as claimed in claim 9, wherein the gripping tongue (39) is formed partially in the region of an end wall (19) of the inner wrapping adjoining the upper wall.

11. A shoulder box as claimed in claim 6, wherein the ends of the tearing zone are defined by transverse stamped portions (40, 41, 42) formed in the region of end walls (19, 32) of the inner wrapping which adjoin the upper wall (18).

12. A shoulder box as claimed in claim 1, wherein the inner wrapping (15) is in the form of a U folded around the cigarette group in the longitudinal direction of the cigarettes (10) such that one of the end walls (19) is closed and the other end wall (32) is formed from folded end-wall tabs (21, 22), longitudinal side walls (33, 34) being formed from longitudinal wall tabs (23, 24; 25, 26) partially overlapping one another.

13. A shoulder box as claimed in claim 1, wherein the inner tin foil wrapping is comprised of a tin foil sheet having an upper wall (18), and an end wall (19) and lower wall (20), arranged in succession in the longitudinal direction of the sheet, and a tear-open thread (35) or tear-open strip (36) being applied uninterruptedly and centrally, over the entire length of the sheet.

* * * * *